US009238549B2

(12) United States Patent
Merey

(10) Patent No.: US 9,238,549 B2
(45) Date of Patent: Jan. 19, 2016

(54) BIN HAVING INNER LINER WITHIN OUTER SHELL

(71) Applicant: Thomas G. B. Merey, Port Hope (CA)

(72) Inventor: Thomas G. B. Merey, Port Hope (CA)

( * ) Notice: Subject to any disclaimer, the term of this patent is extended or adjusted under 35 U.S.C. 154(b) by 0 days.

(21) Appl. No.: 14/120,164

(22) Filed: May 1, 2014

(65) Prior Publication Data

US 2014/0346175 A1 Nov. 27, 2014

(30) Foreign Application Priority Data

May 2, 2013 (CA) ..... 2814568

(51) Int. Cl.

| | |
|---|---|
| ***B65F 1/06*** | (2006.01) |
| ***B65D 25/14*** | (2006.01) |
| ***B65F 1/14*** | (2006.01) |
| ***B65F 1/08*** | (2006.01) |

(52) U.S. Cl.
CPC .. *B65F 1/163* (2013.01); *B65F 1/08* (2013.01)

(58) Field of Classification Search
CPC ..... B65D 25/14; B65F 1/06
USPC ..... 220/263, 495.06
See application file for complete search history.

(56) References Cited

U.S. PATENT DOCUMENTS

| | | | | |
|---|---|---|---|---|
| 3,762,599 | A * | 10/1973 | Bourgeois | 141/391 |
| 6,732,880 | B1 * | 5/2004 | Nash, Sr. | 220/495.06 |
| 7,225,943 | B2 * | 6/2007 | Yang et al. | 220/263 |
| D648,500 | S * | 11/2011 | Haimoff | D34/7 |
| 2004/0206760 | A1 * | 10/2004 | Gagnebin | 220/495.04 |

* cited by examiner

*Primary Examiner* — Anthony Stashick
*Assistant Examiner* — Raven Collins
(74) *Attorney, Agent, or Firm* — Young & Thompson

(57) ABSTRACT

A bin is constructed to maximize the space available for its contents. The bin has an outer cylindrical shell and a cylindrical liner which fits into the shell. The side wall of the liner is composed of a number of segments which interlock to define a complete cylinder. The space between the side wall and the side wall of the shell is minimized as is the space occupied by the mechanism for opening and closing the lid.

19 Claims, 13 Drawing Sheets

BIN HAVING INNER LINER WITHIN OUTER SHELL

This invention relates to bins having pedal-operated lids and more particularly to a bin constructed to maximize the space available for its contents and to minimize the space occupied by the pedal-operated assembly. The invention also relates to a bin which lacks a pedal-operated lid but is also constructed to maximize the space available for its contents This Application claims priority pursuant to 35 USC 119 of Canadian application no. 2,814.568 filed in the Canadian Intellectual Property Office on May 2, 2013, the entire contents of which are hereby incorporated into the following application by reference.

The design of stainless steel trash bins has not changed substantially in the last thirty years. A major innovation introduced in the last ten years has been a sensor-operated lid but otherwise the design has not changed significantly. The structure of a typical bin consists of an outer cylindrical shell of stainless steel and an inner plastic liner for accommodation of a disposable trash bag. The space between the outer shell and the inner liner and between the floor and the liner is partly utilized to hide the pedal activating mechanism but mostly the space is empty.

The consequence of this design is that there is significant unusable space between the shell and liner and as a result, more material is required in the construction of the bin than is required to accommodate a given volume of trash. The additional material adds to the cost of freight, packaging material and storage and in today's world, these costs are substantial. Moreover there is a general public disapproval of merchandise having too much wasted space and wrapped in too much packaging.

I have invented a bin which has substantially less wasted space than many conventional bins having similar outer dimensions. I have reduced the space in a number of ways including reducing the space between the liner and outer shell and redesigning the pedal assembly so that less space is required to accommodate it than many conventional pedal assemblies. Briefly, in one embodiment of the bin of my invention, a liner is composed of a plurality of arcuate segments juxtaposed with one another to define a complete cylinder. In another embodiment of my bin, a diametrically extending torsion shaft is provided in its outer shell. The shaft has a straight central segment and terminal segments at opposite ends which are offset from the central portion. A pedal bears against one of the terminal segment and when the pedal is depressed, it causes the torsion shaft to rotate. An upwardly extending link is pivotally connected to the other terminal segment and also to the lid. The torsion shaft, upon rotation, causes the link to move, either upward or downward depending of which direction the torsion shaft rotates, either clockwise or counterclockwise. Such movement of the link causes the lid to either open and close.

The various embodiments of my bin are described with reference to the accompanying drawings in which.

Figures 11A, 11B, 11C, 11D:
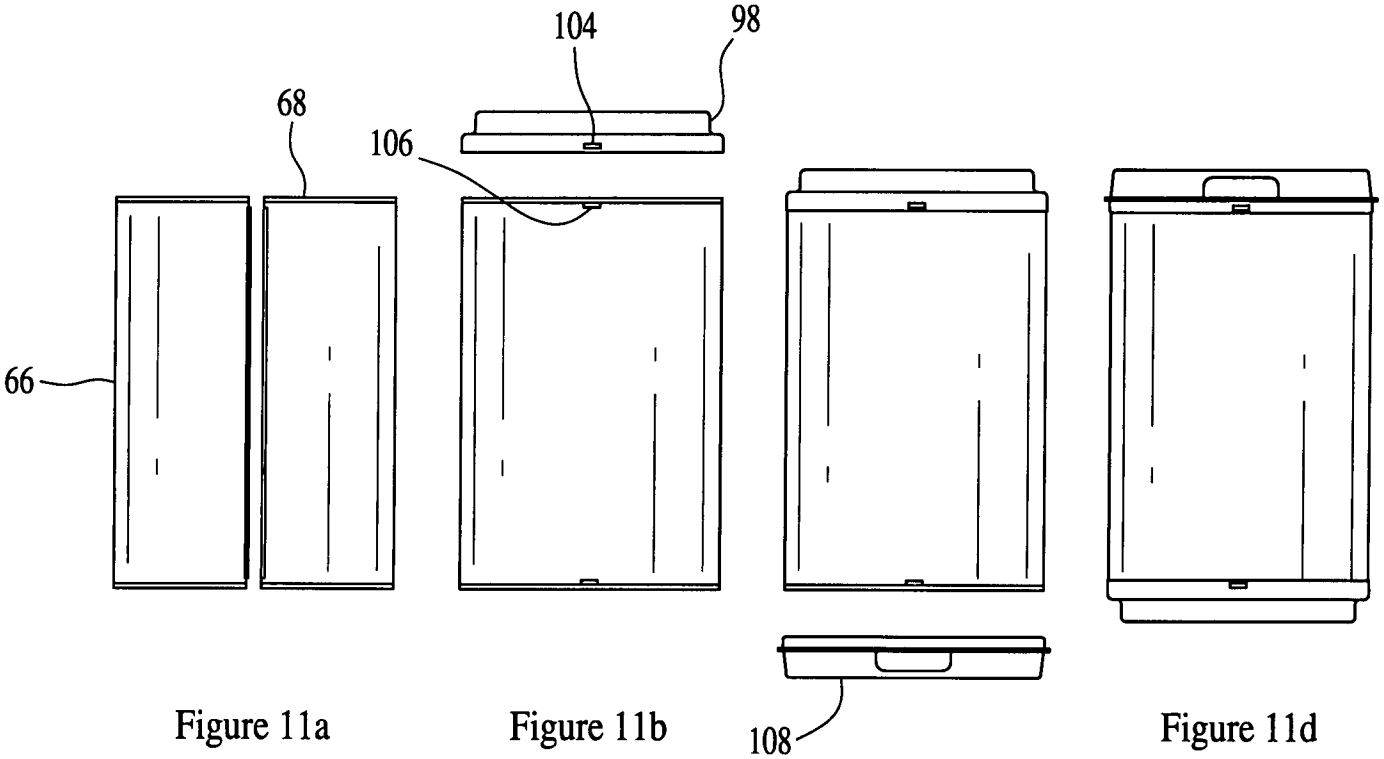
Figure 13:
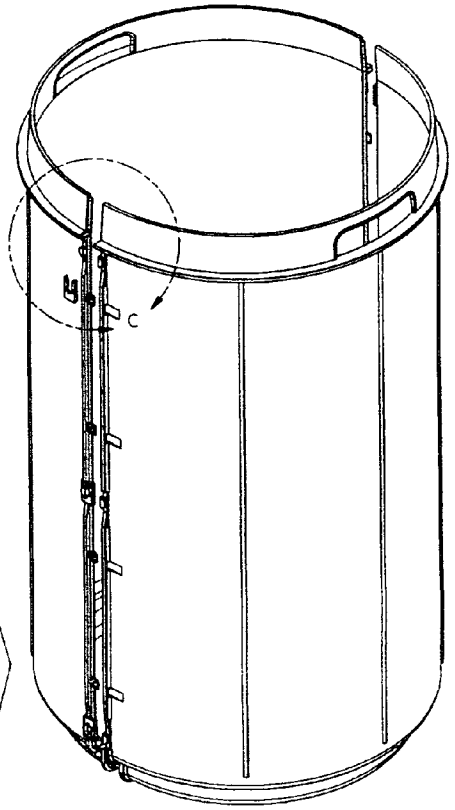
Figure 12:
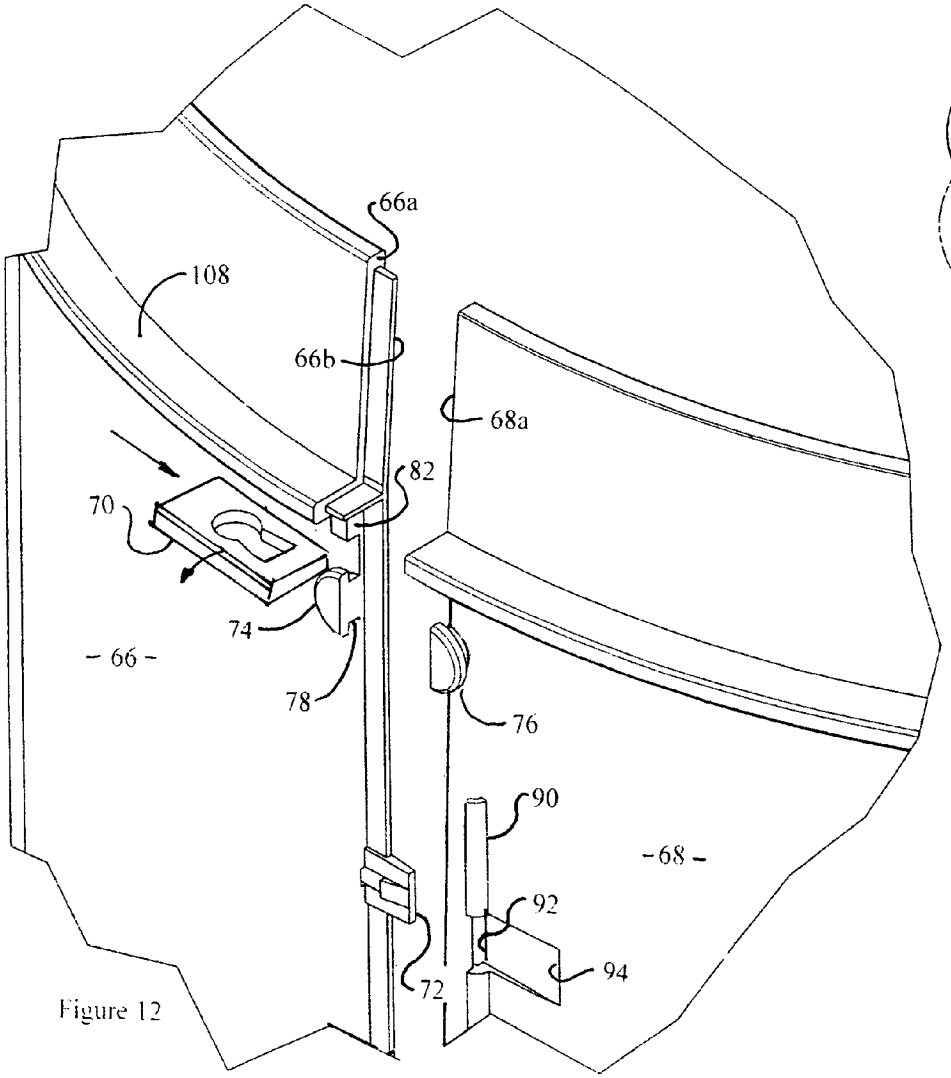
Figure 14:
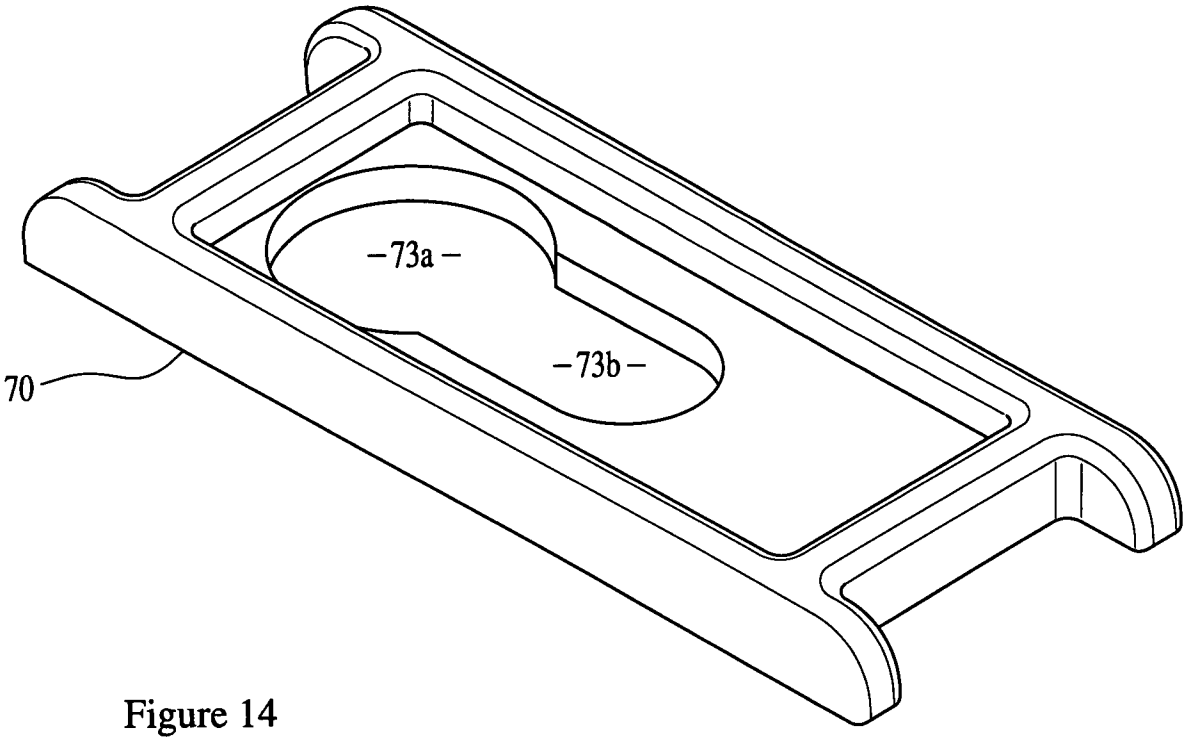
Figure 17:
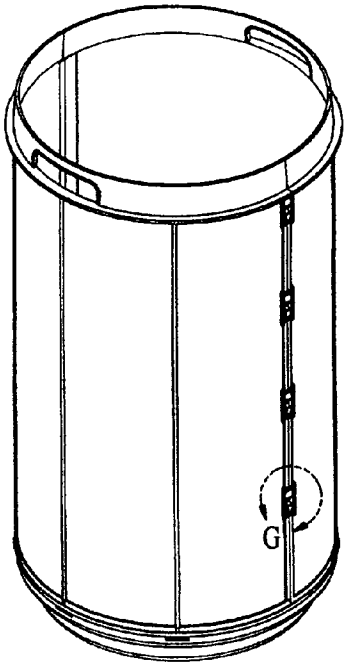
Figure 16:
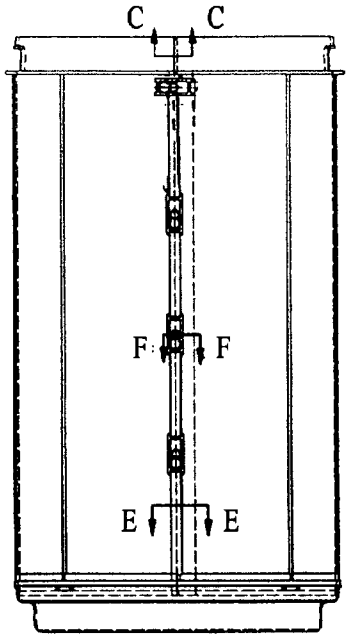
Figure 15:
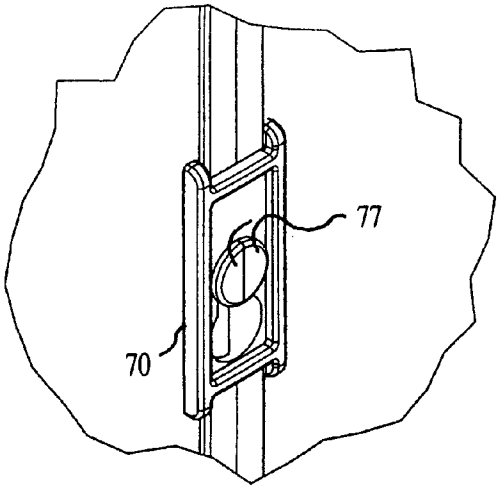
Figure 16E:
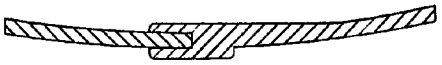
Figure 16F:
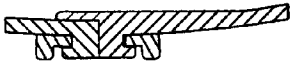
Figure 16C:
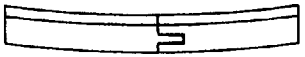
Figure 19:
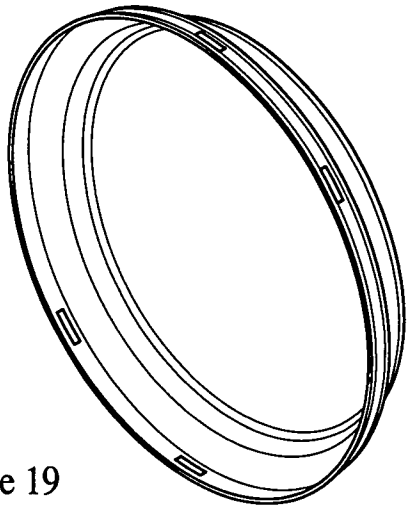
Figure 20:
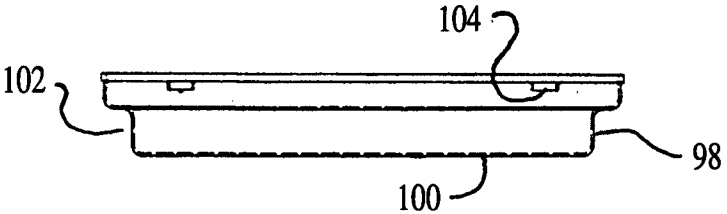
Figure 18:
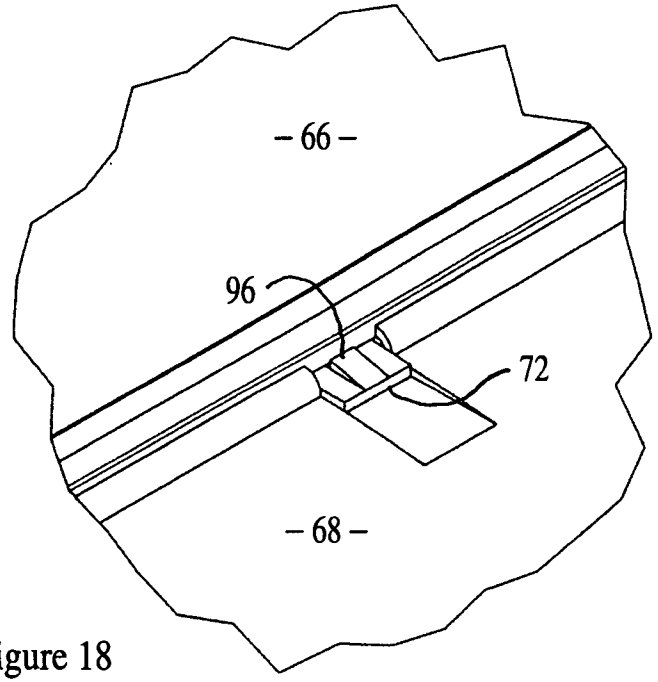

FIGS. 11*a*-11*d* are perspective views of another embodiment of the bin in the course of assembly wherein: FIG. 11*a* is an elevation of two segments of the side wall of the liner separated from one another; FIG. 11*b* is an elevation of one of the segments of the liner illustrated in FIG. 11*a* turned 90 degrees and upside down, which Figure also illustrates an elevation of a bottom plate of the liner; FIG. 11*c* is an elevation of the side wall of the liner illustrated in FIG. 11*b* in combination with an elevation of the bottom plate attached to the side wall and an upper ring detached from the side wall; FIG. 11*d* is an elevation of the side wall plate of the liner in conjunction with the bottom plate and upper ring both attached to the side wall;

FIG. 12 is a fragmentary perspective view, in enlarged scale, of the upper portion of the side wall of the liner of FIG. 11;

FIG. 13 is a perspective view of the bin of FIG. 12;

FIG. 14 is a perspective view of a joiner clip, in enlarged scale;

FIG. 15 is another perspective view of the joiner clip;

FIG. 16 is an elevation of two segments of the side wall and an elevation of clips for interconnecting the segments;

FIGS. 16*e*, 16*f* and 16*c* are cross-sections on lines E-E, F-F and C-C of FIG. 16;

FIG. 17 is a perspective view of two segments of the side wall of the liner joined by a number of clips;

FIG. 18 is a perspective view of a ratchet-like fastener;

FIG. 19 is a perspective view of the pan or bottom plate of the liner;

FIG. 20 is an elevation of the pan or bottom plate of the liner; and

Figure 21:
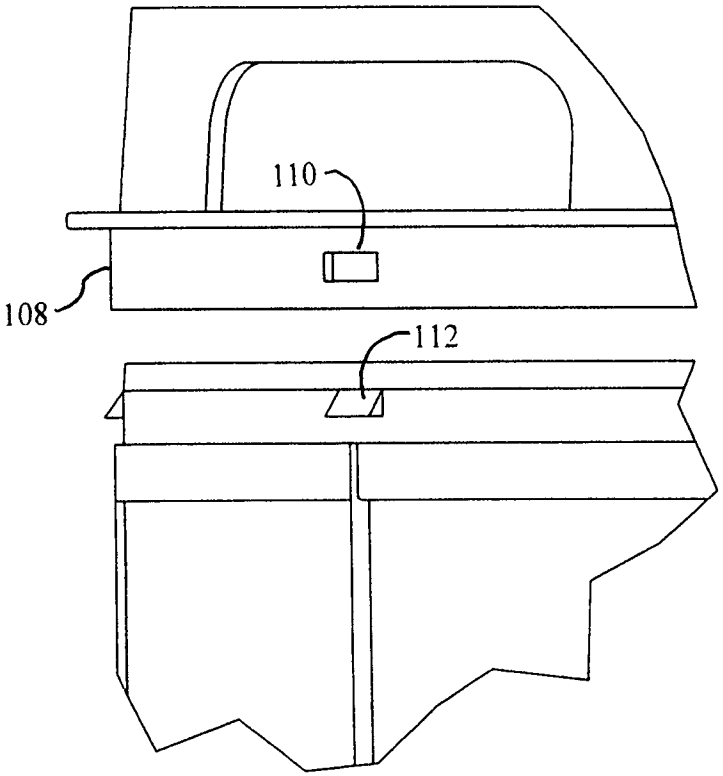

FIG. 21 is a fragmentary elevation of the side wall and the upper ring of the liner.

Like reference characters refer to like parts throughout the description of drawings.

Figure 1:
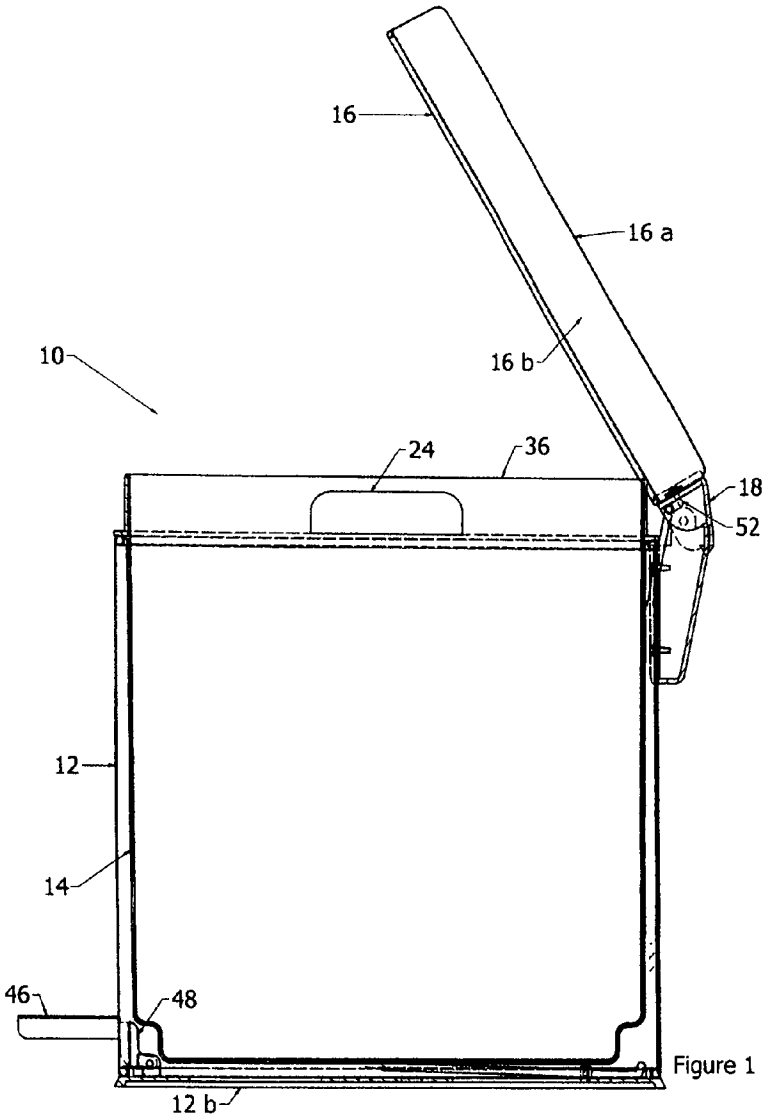
FIG. 1 is an elevation of the bin, partly in section.
Figure 2:
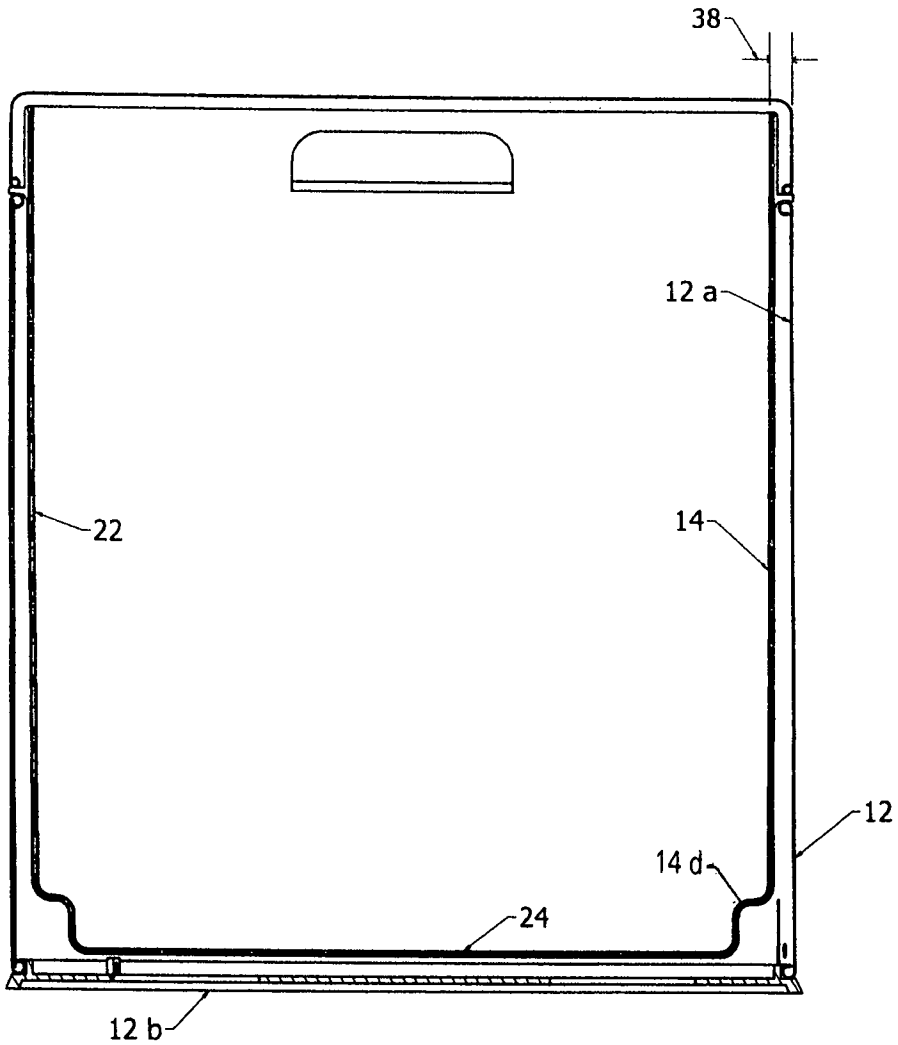
FIG. 2 is an elevation of the shell and liner of the bin, partly in section.
Figure 3:
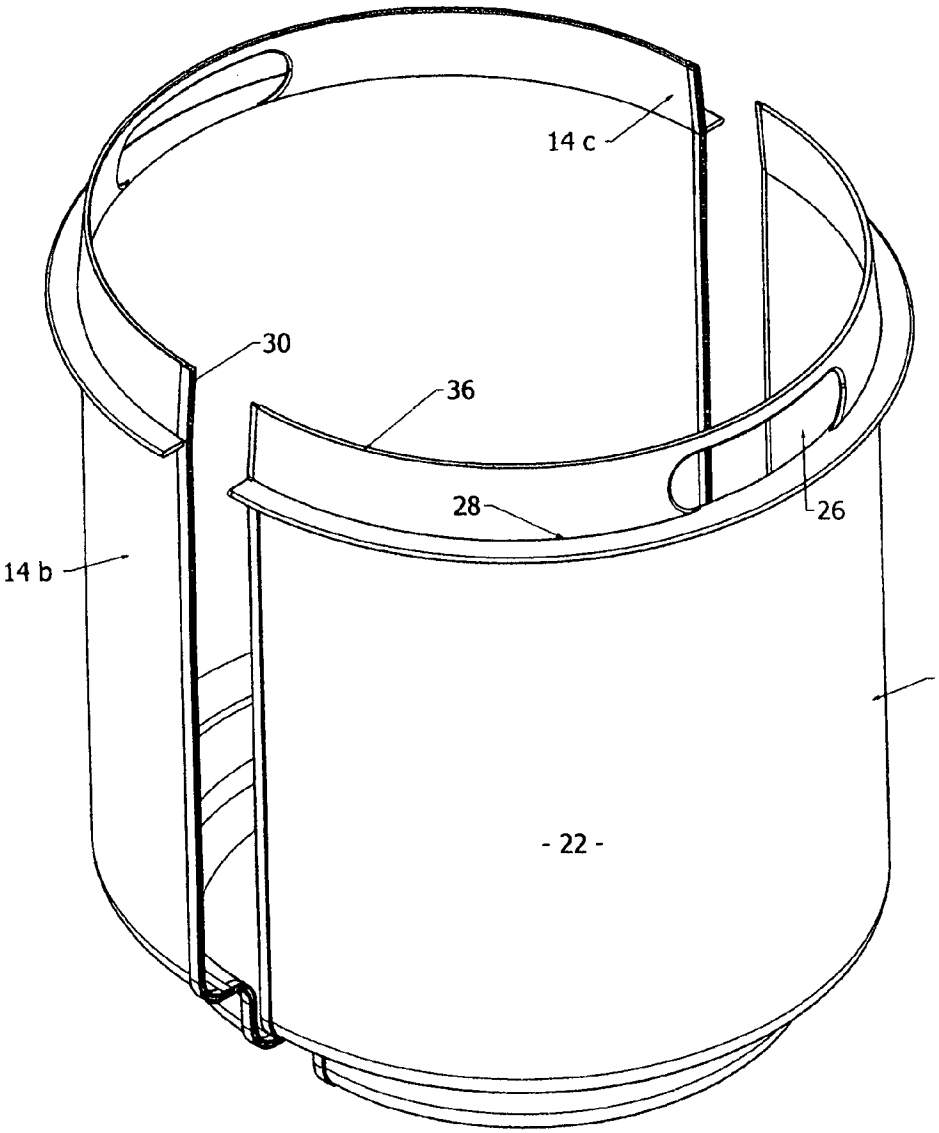
FIG. 3 is a perspective view of the segments of the liner separated from one another.

With reference to FIGS. 1-3, the bin of the invention, generally 10, is composed of an outer shell 12, an inner liner 14 and a lid 16 all of which are cylindrical in shape. The shell has an outer side wall 12*a* having a circular lower wall 12*b* which is adapted to rest on a floor. As is conventional, the outer side wall extends vertically upward when the lower wall is resting on a level floor.

The lid is attached to the shell by a hinge assembly 18 which is described in detail below. The lid is composed of a circular upper wall 16*a* and an annular rim 16*b* which extends downwardly from the outer edge of the upper wall. The rim rests on an outwardly extending ring 28 of the shell when the lid is closed.

Figure 7:
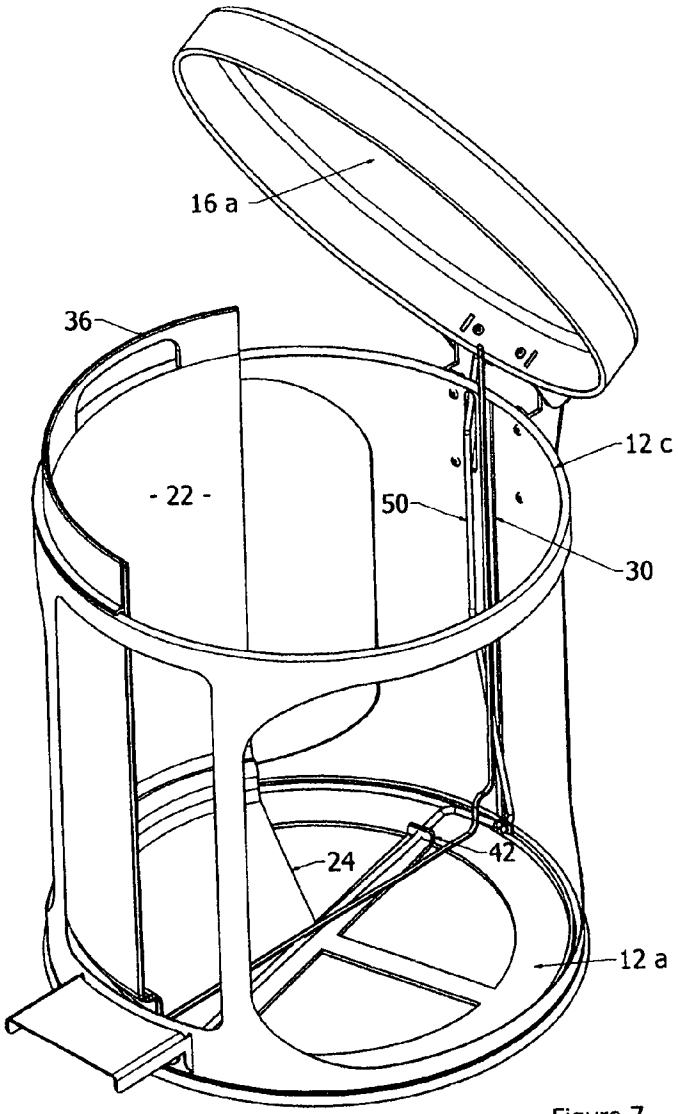
FIG. 7 is a perspective view of the bin partly cut open to show its interior.
Figure 8:
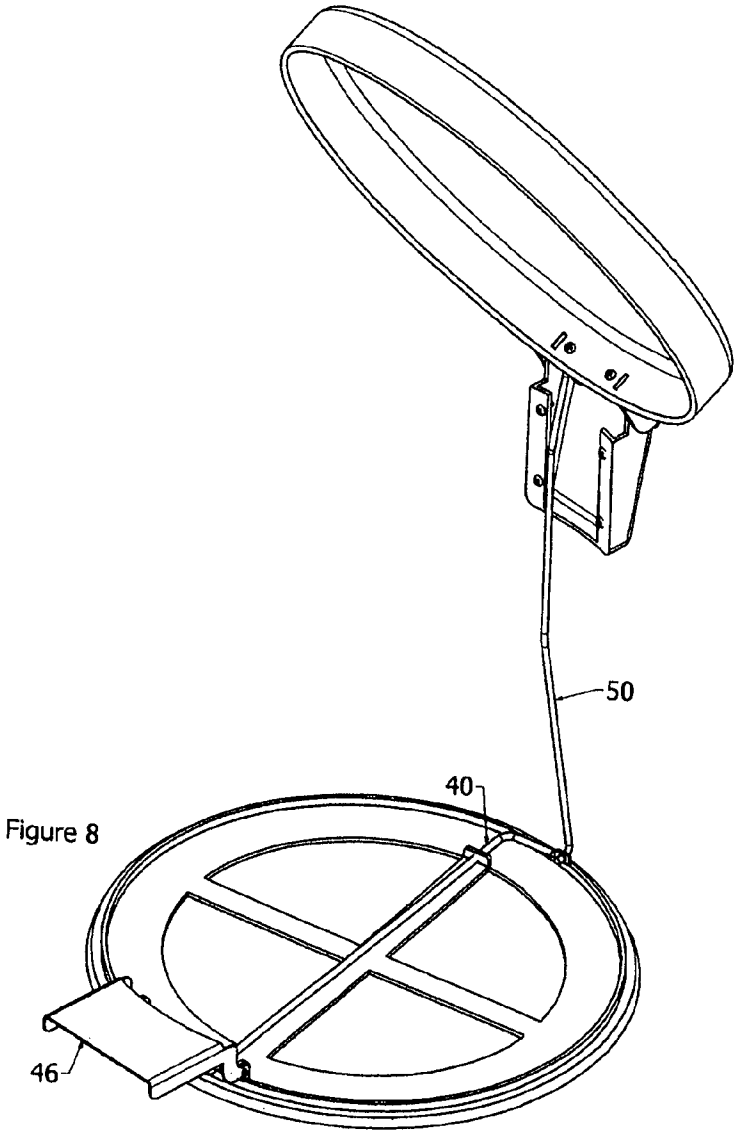
FIG. 8 is a perspective view of the pedal activating mechanism together with the link and base of the shell.
Figure 10:
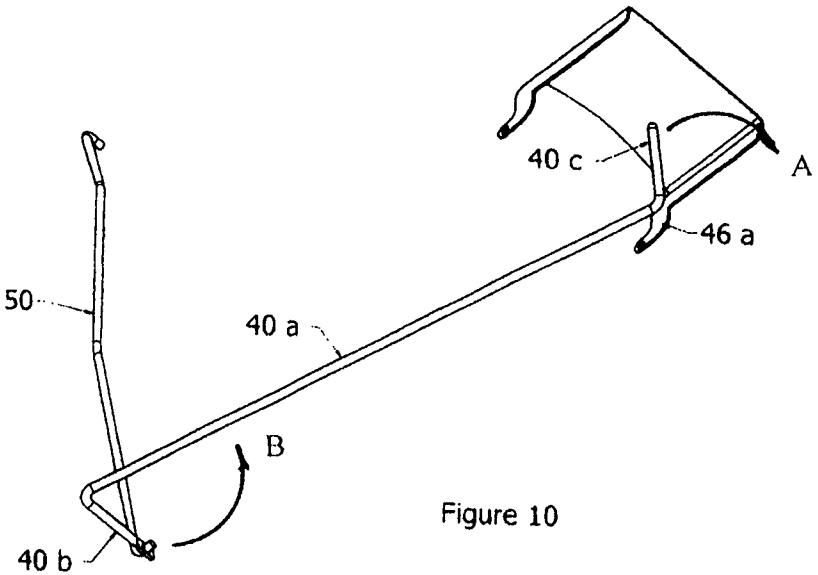
FIGS. 9 and 10 are perspective views of the pedal activating mechanism from above and below, respectively.
Figure 9:
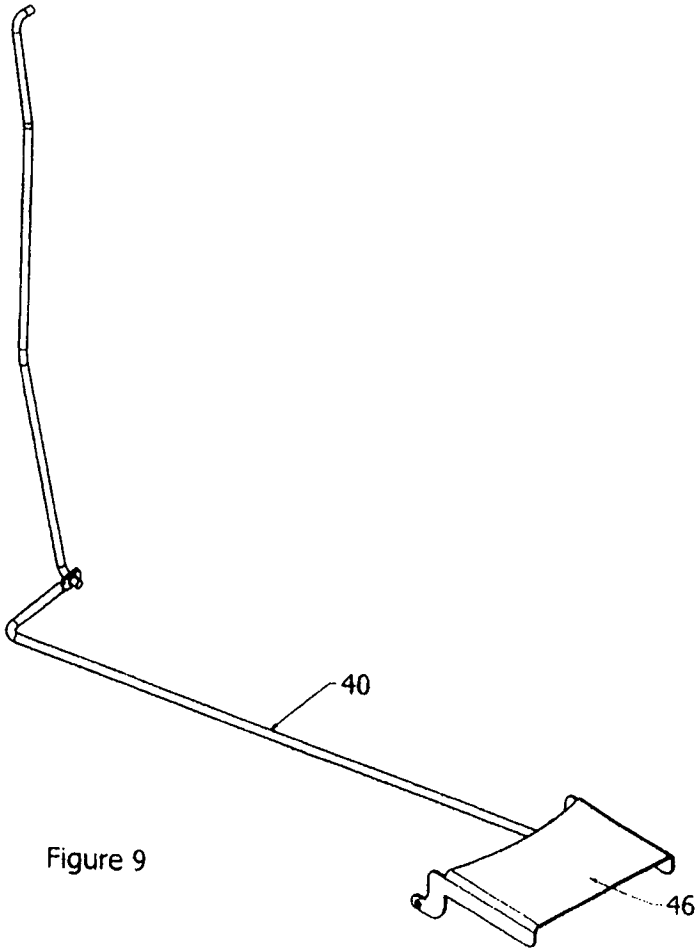

The liner is composed of three segments 14*a, b* and *c*, and each has an arcuate side wall 22 and a pie shaped lower wall 24 (FIG. 7). The segments are identical in shape and interconnect to form the complete liner.

There is an opening 26 in the upper portion of each segment for accommodation of a user's fingers to facilitate the lifting of the liner from the shell or the placement of the liner into the shell. Beneath the openings is ring 28 on which the lower edge of the rim of the lid rests when the liner is within the shell and the lid is closed.

Figure 6:
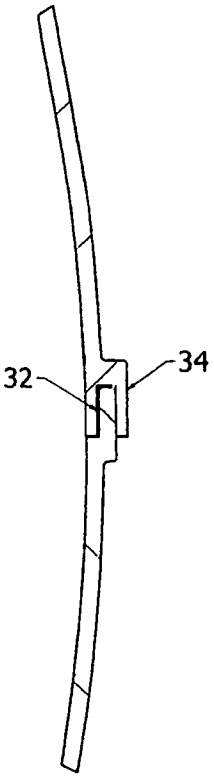
FIG. 6 is a section of one segment of the liner on line A-A of FIG. 5.
Figure 5:
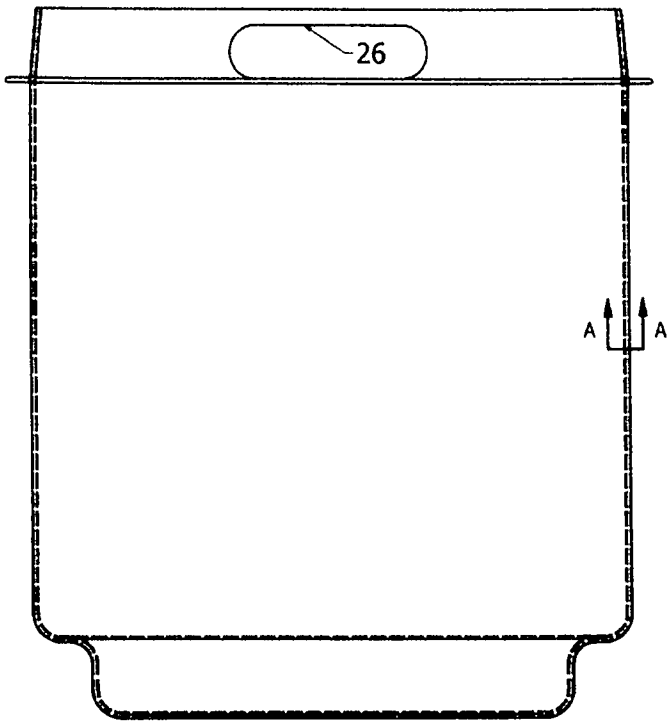
FIG. 5 is another elevation of the liner rotated 90 degrees from its position in FIG. 4.
Figure 4:
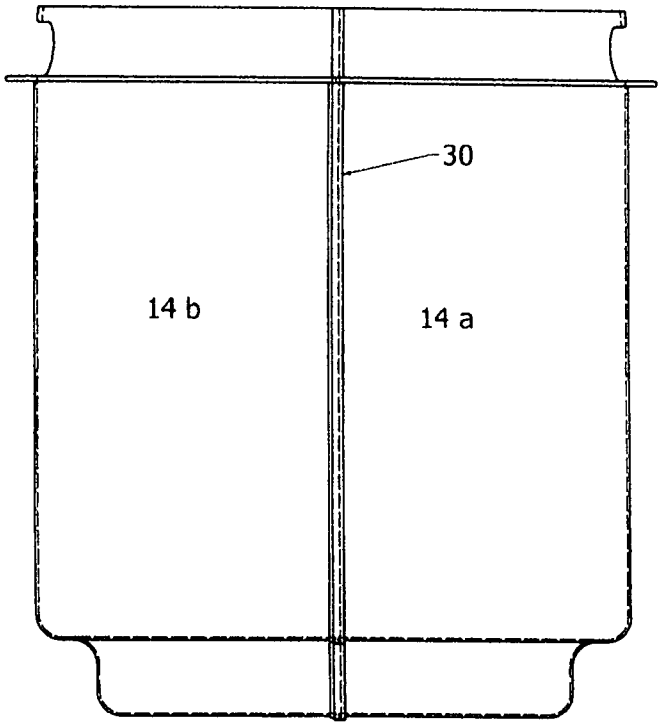
FIG. 4 is an elevation of the liner.

With reference to FIGS. 3-6. each segment 14 of the liner has vertically extending side edges 30 which contact like side edges of the remaining two segments when the segments together define the complete liner. The segments may be interconnected by glue, by welds or, as illustrated in FIG. 6, by conventional tongues 32 and grooves 34. In the latter case, a tongue is formed on one side edge of each segment of the liner and a groove is formed on the opposite side edge.

With reference to FIG. 2, The inner side wall 14 adjacent to the lower wall 24 of the liner is stepped inward at 14*d* is provide space for the mechanism which operates the pedal-operated lid, The mechanism is described below. However the bin of the invention need not be provided with such a mechanism In the absence of the mechanism, the lid may be opened and closed by hand.

The bin is constructed to make maximum use of the space of both its upper portion and within its sides. As for the upper portion and with reference to FIGS. 1, 3 and 7, the liner extends upward and terminates at an upper edge 36 adjacent to the upper wall 16*a* of the lid. There is no wasted space between the lid and the upper edge of the liner which holds on the contents of the bin such as trash.

As for the space within the outer side walls of the shell and with reference to FIG. 2, the outer side wall 12*a* of the shell, when the bin is in use is vertical as is conventional and its circumference is the same throughout its height. The inner side wall 22 of the liner can be parallel to outer side wall 12*a* or it can taper downward from a maximum cross-section at its upper edge to a minimum cross-section where it is steped inward at 14*d* immediately above the lower wall 24. The angle between the inner side wall of the liner and the outer side wall 12*a* of the shell, referred to below as the 'taper angle" is indicated 38 in FIG. 2.

The taper angle of the subject liner is to be contrasted with the taper angle of a conventional bin which typically is about 2 degrees. The reason why the taper angle of a conventional bin is significantly larger than that of the subject liner is because a conventional liner is formed by injection molding as a single unit. A liner having a taper angle of less than about 2 degrees can only be removed from a mold with great difficulty. By contrast, the subject liner, having a smaller angle, can be easily removed from a mold because it is formed in segments as described above. As such, the taper angle can be any angle including 0.

The gap between the liner and shell is wasted space. In a large 30 liter bin that is 24" high and a taper angle of 2 degrees, there is a 1" gap between the liner and shell around the whole lower circumference. This is a significant volume of wasted usable space.

With reference to FIGS. 7-10, a torsion shaft 40 extends diametrically across the shell and is mounted for pivoting or rotation in openings formed in a pair of upstanding ears 42 in the lower wall 12*a* of the shell. The torsion shaft is composed of three segments, a straight central segment 40*a* and, at opposite ends, terminal segments 40*b,c*. The central segments extend generally horizontally while the terminal segments are offset from the central portion.

As illustrated in FIGS. 1 and 7-10. a pedal 46 extends outwardly from the shell and has a pair of lips 46*a* which are pivotally mounted to a pair of tabs 48 which extend upwardly from the lower wall 12*b* of the shell. Terminal segment 40*c* of the torsion shaft is positioned beneath the pedal and when the pedal is depressed, the pedal bears against the terminal segment and causes it to pivot downwardly in the direction of arrow A. As the terminal segment pivots, the torsion shaft rotates approximately about one quarter turn.

The opposite terminal segment 40*b* is pivotally attached to a link 50 which extends upwardly and terminates at lid 16. The link extends into an opening in lip 52 of the rim as illustrated in FIG. 1. When pedal 46 is depressed, the torsion shaft rotates and the terminal segment 40*b* pivots upward in the direction of arrow B with resulting elevation of link 50. As the link rises, the lid pivots open.

When the pedal is no longer depressed, the weight of the lid on the link causes the link to descend with resulting counter rotation of the torsion shaft. Terminal segment 40*c* then bears against the lower wall of the pedal in the direction opposite to arrow A and causes the pedal to return to its upper inactive position.

Torsion shaft 40 is oriented parallel to and adjacent to the lower wall 12*b* of the shell. Preferably the torsion shaft is spaced apart from the lower wall by a distance only sufficient to clear the lower wall. In other words, the shaft is very close to the lower wall but not so close that the lower wall prevents the shaft from turning. The torsion shaft therefore occupies little space in the interior of the shell For that reason maximum use is made of the space in the lower portion of the bin.

If the pedal-operated lid is eliminated from the subject bin, the inner side wall of the liner can he cylindrical of the same or gradually increasing circumference throughout its entire height from the lower wall 24 to it upper edge 36. The liner will accordingly lack the inwardly stepped portions 14*d* of the inner side walls illustrated in FIG. 2 and, as a result, will have a larger volume than a liner with stepped-in side walls.

With reference to FIG. 11*a*, the side wall of the liner is composed of a pair of arcuate segments 66, 68 each semicircular in shape. The segments are adapted to be arranged side by side one another to define a hollow cylindrical segmented side wall which is downwardly and upwardly opening. In this respect the side wall is the same as the side wall in the previously described liner. However the side wall of FIGS. 11*a* is vertical when seated on a level surface and is to be contrasted with the side wall illustrated in the previous drawings in which the side wall tapers inward.

In FIG. 11*b* the side wall is turned upside down and a pan or a bottom plate 98 is attached to the segments from above. The means of attachment is described below. In FIG. 11*c* an upper ring 108 is attached from below to the opposite end of the side wall and in FIG. 11*d* the liner is fully assembled and rotated so that the ring is above the side wall and the pan or bottom plate is below the side wall.

With reference to FIGS. 12 and 13, the two side wall segments 66, 68 of the liner have side edges 66*a*, 66*b* which face one another. The two segments are joined by a tongue and groove. The tongue 66*b* extends from the lower to the upper edge of segment 66 and is accommodated in a groove (not visible) in segment 68.

The side edges of the side wall segments are prevented from separating by either a joiner clip 70 or a ratchet-like fastener 72.

In most cases a number of joiner clips or ratchet-like fasteners will be used to secure the segments of the side wall together but not both. In other words, clips 70 and fasteners 72 are alternative means for securing the two segments together however it is possible to used both means if that is appropriate.

With reference first to the joiner clip which is illustrated in both FIGS. 12 and 14, the clip is generally rectangular and has a key-hole shaped aperture composed of a semicircular area 73*a* and a groove 73*b*. The clip is attached to knobs 74, 76 formed adjacent to the edges of the two side wall segments. Both knobs have semicircular head and when the two side wall segments are in contact with each other, the two heads are adjacent to one another and their outer edges define a full circle. Both knobs then fit into the semi-circular area 73*a* of the aperture in the joiner clip when the clip is rotated 90 degrees from its position shown in FIG. 12. By introducing the heads of the two knobs through area 73*a* and sliding the clip until the necks 78 of the two knobs are in groove 73*b*, the clip functions to interconnect the two knobs.

Like knobs are spaced along the length of the side edges of both segments of the side wall of the liner for interconnecting the segments along their full height.

To prevent the knobs from sliding out of the semi-circular portion of the knobs, all the clips but the uppermost ones immediately beneath ring 80 are attached so that the groove 73*b* in the clip is uppermost as illustrated in FIG. 15. The clips will then remain stationary.

As for the uppermost clip, and with reference to FIG. 12, a protuberance 82 is formed on the wall segment 66 beneath ring 108. If the clip is horizontal i.e. the axis of symmetry of its aperture is horizontal when it is attached to the knobs, the protuberance is in position to contact the upper wall of the clip and to prevent the clip from sliding sideways. The clip will then remain stationary and not separate from the knobs.

FIG. 16 illustrates the two segments of the side wall joined by a number of clips spaced vertically along the joint between the two side wall segments. FIG. 16*e* is a cross-section on line E-E of FIG. 16, FIG. 16*f* is a cross-section on line F-F of FIG. 16 and FIG. 16*c* is a cross-section of ring 108 on line C-C.

With reference to FIGS. 12 and 18, the ratchet-like fastener 72 is attached to tongue 66*b* of side wall segment 66. A ridge 90 is formed on the the other side wall segment and an opening 92 and a groove 94 are formed on the other side wall segment for receipt of the fastener when the two side wall segments are side by side. The fastener is provided with a resilient engaging flap 96 which is forced down by the upper wall of the opening when the two side wall segments are being attached to each other and which springs up when the two are fully attached and prevents the two segments from being separated.

With reference to FIGS. 19 and 20 the bottom of the liner is in the shape of a pan 98 having a bottom wall 100 and an upstanding cylindrical side wall. 102 which extends upwardly from the periphery of the bottom wall. Openings 104 are spaced around the side wall for receipt of tabs 106 spaced around the periphery of the segmented side walls as illustrated in FIG. 11*b*. The bottom wall is attached to the segmented side walls when the tabs are within the openings. When the liner is righted as illustrated in FIG. 11*d*, any liquid which flows into the liner will discharge into the pan and remain confined in it.

Similarly and with reference to FIG. 21, the upper ring 108 is provided with openings. 110 for receipt of tabs 112 which extend radially outward from the upper portion of the side walls for attachment of the upper ring to the side walls.

It will be understood of course, that the structure of the bin of the invention can be modified without departing from the scope and purview of the invention as defined in the appended claims.

I claim:

1. A liner for use within an outer cylindrical shell having an upstanding outer side wall which, when said shell is positioned for use, extends vertically upward, said liner comprising:

a plurality of arcuate segments interconnected such that said segments are immobile relative to each other and are disposed side by side with one another thereby defining a hollow cylindrical segmented side wall which is adjacent to and parallel to said outer side wall when said liner is disposed within said shell throughout substantially an entire length of said segmented side wall of said liner.

2. The liner of claim 1, in combination with said shell, wherein the side wall of said liner is parallel to said outer side wall when said liner is disposed within said shell being adjacent to and parallel to said outer wall throughout substantially the entire length of said segmented side wall of said liner.

3. The combination of claim 2, wherein said liner has an upper edge in contact with said outer side wall.

4. The combination of claim 2, wherein said liner has an upper edge, said upper edge being separated from said outer side wall by a space sufficient only to permit said liner to be manually removed from said shell but no more.

5. The combination of claim 2, further including a lid for covering said shell, said lid having an upper wall, said liner having an upper edge disposed adjacent to said upper wall when said lid is closed.

6. The combination of claim 5, wherein said upper edge of said liner touches said upper wall when said lid is closed.

7. The liner of claim 1, further comprising a pan adapted to define a bottom wall of said liner, said pan having a lower wall and a cylindrical wall which extends upwardly from said lower wall; interconnecting means for attaching said cylindrical wall to said segmented side wall such that any liquid which flows downward from within said segmented side wall discharges into said pan and remains confined therein.

8. The liner of claim 7, wherein said cylindrical wall of said pan and said segmented side wall both have oppositely facing inner and outer surfaces, said interconnecting means comprising a plurality of tabs formed on the outer surface of said segmented side wall, said tabs fitting into conforming openings in said cylindrical wall with resulting engagement of said cylindrical wall of said pan with said segmented side wall.

9. The liner of claim 8, wherein said openings are defined by edges, said tabs being retained within said openings by friction between said tabs and said edges.

10. The liner of claim 7, wherein said segmented side wall has oppositely facing lower and upper edges, said liner further including an upper ring adapted to be seated on said upper edge, said ring being provided with a handle.

11. The liner of claim 10, wherein said handle is formed by a apertures in said ring, said apertures being adapted to receive fingers of a person to facilitate the carrying of the liner by the person.

12. The liner of claim 1, wherein said liner has oppositely facing inner and outer walls, said inner wall having a height and a substantially uniform cylindrical inner surface throughout an entirety of the height of the inner wall.

13. The liner of claim 1, wherein said liner has oppositely facing inwardly and outwardly facing walls, said outwardly facing wall being disposed vertically when said liner is positioned within said shell for use.

14. The liner of claim 1, wherein a taper angle between said outer wall of said shell and said side wall of said liner is zero.

15. The liner of claim 1, wherein an inner wall of said liner has a height and has a substantially uniform cylindrical inner surface throughout an entirety of the height of the inner wall of said liner.

16. The combination of claim 2, wherein said liner has oppositely facing inner and outer walls, said inner wall having a height and a substantially uniform cylindrical inner surface throughout an entirety of the height of the inner wall.

17. The combination of claim 2, wherein said liner has oppositely facing inwardly and outwardly facing walls, said outwardly facing wall being disposed vertically when said liner is positioned within said shell for use.

18. The combination of claim 2, wherein a taper angle between said outer wall of said shell and said side wall of said liner is zero.

19. The combination claim 2, wherein, said liner further comprises i) a pan that defines a bottom wall of said liner, said pan having a lower wall part and a cylindrical wall part which extends upwardly from said lower wall part, and ii) interconnecting means for attaching said cylindrical wall to said segmented side wall such that any liquid which flows downward from within said segmented side wall discharges into said pan and remains confined therein, said segmented side wall has a height and an inner wall with a substantially uniform cylindrical inner surface throughout an entirety of the height of the inner wall.

* * * * *